United States Patent [19]

Lancaster et al.

[11] 4,078,462

[45] Mar. 14, 1978

[54] GUARD FOR A PUNCH PRESS

[75] Inventors: Paul M. Lancaster; Bruce E. Ahmer, both of Rockford, Ill.

[73] Assignee: W. A. Whitney Corporation, Rockford, Ill.

[21] Appl. No.: 735,116

[22] Filed: Oct. 22, 1976

[51] Int. Cl.[2] ..... B26D 7/22; B26F 1/14

[52] U.S. Cl. ..... 83/146; 83/546

[58] Field of Search ..... 83/145, 146, 544, 545, 83/546, DIG. 1; 74/612

[56] References Cited

U.S. PATENT DOCUMENTS

| | | | |
|---|---|---|---|
| 178,937 | 6/1976 | Lewis | 83/146 |
| 683,363 | 9/1901 | Werle | 83/146 |
| 1,387,553 | 8/1921 | Miller | 83/544 |
| 1,447,987 | 3/1923 | Johnson | 83/546 X |
| 2,420,905 | 5/1947 | Olsen | 408/56 |
| 2,491,035 | 12/1949 | Deacon | 83/544 X |
| 3,720,125 | 3/1973 | Scott | 83/146 |

*Primary Examiner*—Frank T. Yost

*Attorney, Agent, or Firm*—Leydig, Voit, Osann, Mayer & Holt

[57] ABSTRACT

A transparent sleeve made of impact-resistant plastic is fitted removably around the angularly spaced stripper fingers of a punch press and encloses the spaces between the fingers to prevent parts of the punch from flying out through such spaces in the event the punch should break.

5 Claims, 5 Drawing Figures

GUARD FOR A PUNCH PRESS

BACKGROUND OF THE INVENTION

This invention relates to a punch press of the type in which a reciprocating punch coacts with an underlying die to form a hole through an intervening workpiece when the punch is shifted through an advance stroke. When the punch is shifted reversely through a return stroke, a stripper engages the workpiece and strips the latter off of the punch. The stripper of such a press usually comprises a pair of angularly spaced fingers which extend along opposite sides of the punch.

SUMMARY OF THE INVENTION

The general aim of the present invention is to provide a punch press having a simple and inexpensive guard which encloses the spaces between the stripper fingers and prevents pieces of the punch from flying through such spaces in the event the punch should break, the guard also serving to prevent the press operator's fingers from being inserted into the spaces between the stripper fingers.

A further object is to provide a guard which enables the press operator to see the punch and which may be easily removed from the stripper to enable changing of the punch.

Still another object is to provide a guard adapted to surround the die and to shield the space between the punch and the die when the press is idle and a workpiece is not present.

In a more detailed sense, the invention resides in the provision of a guard in the form of a sleeve made of transparent and impact-resistant plastic, the sleeve being sized to telescope onto the stripper fingers to enclose the spaces therebetween and preferably being split along one side to permit easy installation and removal of the sleeve.

Another object is to provide a guard sleeve which is uniquely shaped so as to reduce interference between the sleeve and irregularly shaped workpieces.

These and other objects and advantages of the invention will become more apparent from the following detailed description when taken in conjunction with the accompanying drawings.

DETAILED DESCRIPTION OF THE PREFERRED EMBODIMENTS

Figure 1:
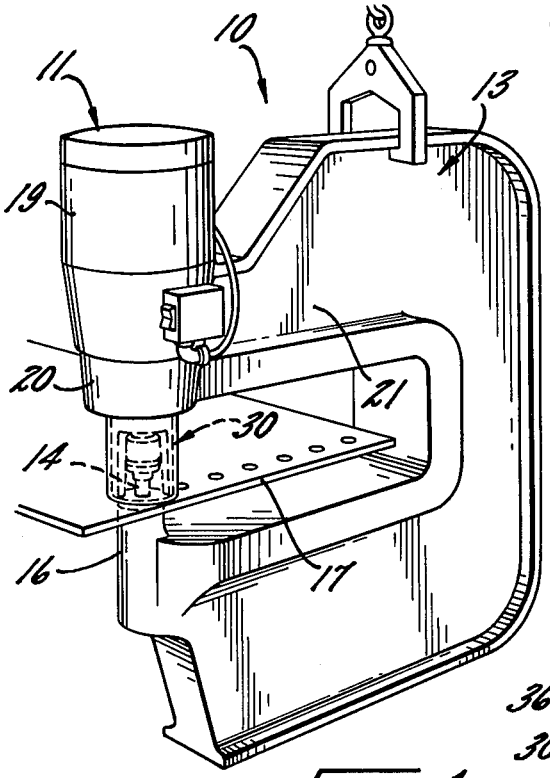
FIG. 1 is a perspective view of a punch press having a new and improved guard incorporating the unique features of the present invention.

As shown in the drawings for purposes of illustration, the invention is embodied in a punch press 10 having a fluid-operated actuator 11 supported on a generally C shaped frame 13 and operable to reciprocate a punch 14 through advance and return strokes relative to a die 15. The latter is fixed to a lower arm 16 of the frame in vertical alinement with the punch and coacts with the punch to form a hole in an intervening workpiece 17 when the punch is advanced downwardly. A punch press of this general type is disclosed in Brolund U.S. Pat. No. 3,469,487.

As shown most clearly in FIG. 1, the fluid-operated actuator 11 includes a cylinder 19 disposed above a sleeve 20 on the free end of the upper arm 21 of the C-frame 13. The cylinder slidably receives a piston (not shown) adapted to reciprocate downwardly and upwardly in the cylinder in response to the admission of pressure fluid alternately into opposite ends of the cylinder. Anchored to the lower end of the piston and projecting through the sleeve 20 is a ram 23 (FIG. 2) to which the punch 14 is attached. For this purpose, the punch is telescoped into a coupling nut 24 whose upper end portion is threaded onto a cylindrical neck 25 formed on the lower end of the ram. As the coupling nut is tightened, mating tapers 26 on the nut and the punch engage one another to draw the upper end of the punch into tight abutment with the lower end of the neck.

Figure 2:
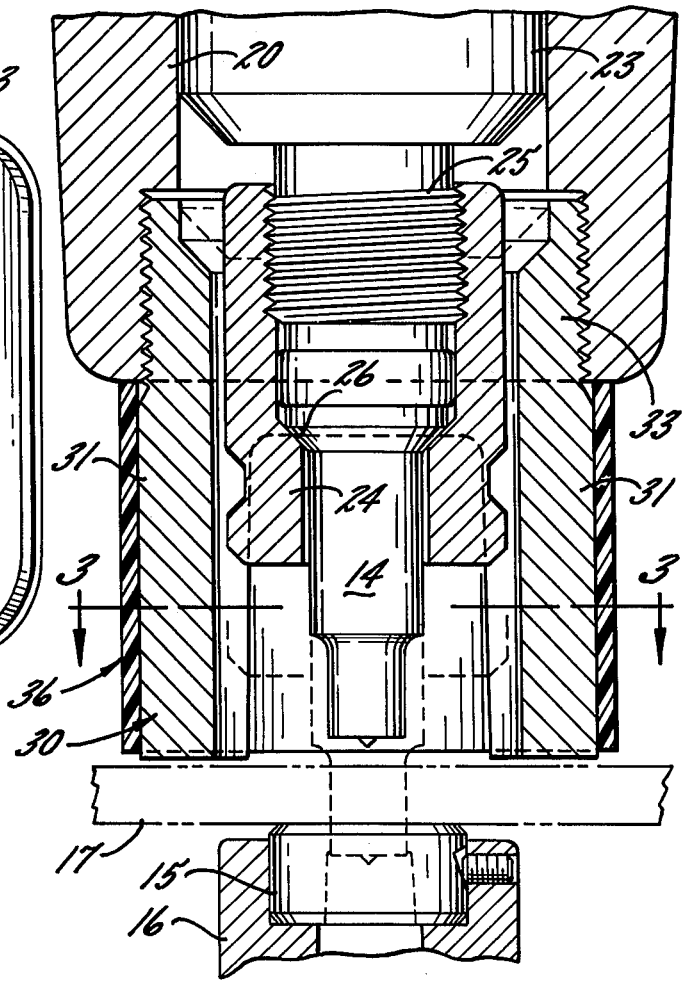
FIG. 2 is an enlarged cross-section of certain parts of the press shown in FIG. 1.

When the punch 14 shifts upwardly through its return stroke, a stripper 30 engages the upper side of the workpiece 17 and strips the workpiece from the punch so as to keep the workpiece from being pulled upwardly with the punch. Herein, the stripper is formed by a pair of angularly spaced fingers 31 whose upper ends are integral with an annular collar 33 (FIG. 2). The latter is threaded into the lower end of the sleeve 20 and may be adjusted upwardly and downwardly to keep the lower ends of the fingers in close proximity to workpieces of different thickness.

The two stripper fingers 31 extend downwardly along diametrically opposite sides of the punch and are formed with arcuate inner and outer surfaces. Each finger extends through an arc of approximately sixty degrees and thus two relatively large gaps or spaces 35 (FIG. 3) are left between the fingers. The spaces 35 are necessary to enable an open end wrench (not shown) to be engaged with the coupling nut 24 for the purpose of initially loosening and finally tightening the nut. When the wrench is used, its ears straddle one of the fingers and project into the spaces 35 into engagement with the coupling nut.

In accordance with the present invention, the spaces 35 between the stripper fingers 31 are enclosed by a unique guard 36 which prevents pieces of the punch 14 from flying through the spaces in the event the punch should break and which, at the same time, prevents the operator of the press 10 from inserting his fingers into the spaces and between the punch and the workpiece 17 or between the punch and the die 15 if the workpiece is not present. The guard 36 of the invention is particularly characterized by its simple and inexpensive construction and by its ability to be easily removed from the stripper 30 to enable changing of the punch 14.

More specifically, the guard 36 is in the form of a cylindrical sleeve adapted to encircle the stripper 30 and made of a substantially transparent and impact-resistant plastic such as polycarbonate or cellulose acetate-butyrate, the plastic being resiliently yieldable and yet being strong and capable of retaining its initially formed cylindrical shape. The length of the guard sleeve 36 is approximately equal to the length of the stripper fingers 31 while the inside diameter of the sleeve is equal to or just slightly less than the diameter of the circle extending around the arcuate outer surfaces of the fingers.

Figure 3:
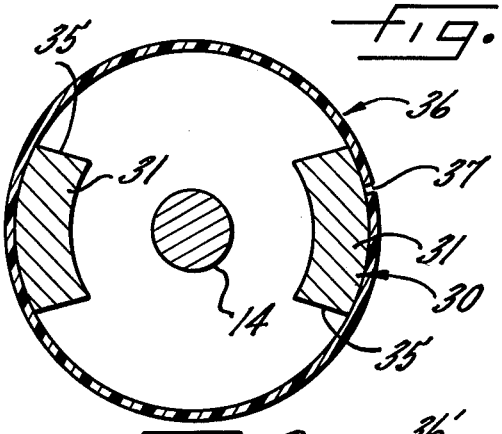
FIG. 3 is a reduced cross-section taken substantially along the line 3—3 of FIG. 2.

Preferably, the sleeve 36 is split axially along one side thereof as indicated at 37 in FIG. 3, the split 37 extending along the entire length of the sleeve. As a result of the split 37, those edge portions of the sleeve adjacent the split may be flexed and spread apart to enable the sleeve to be slipped radially onto the stripper 30. When the edge portions of the sleeve are released, the sleeve contracts resiliently around the stripper fingers 31 and holds itself in place. The sleeve may be removed simply by spreading its edge portions and slipping the sleeve radially off of the stripper. Thus, the sleeve may be easily taken off of the stripper to enable the coupling nut wrench to be inserted through the spaces 35 and then may be quickly re-installed once the punch 14 has been locked in place. If desired, a clamp such as a hose clamp may be tightened around the sleeve 36 to provide strict compliance with those safety standards which require that guards be secured in place.

Figure 4:
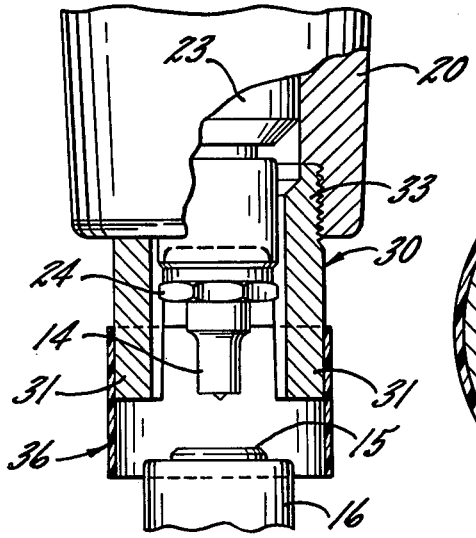
FIG. 4 is a view similar to FIG. 2 but on a reduced scale and showing the guard in a moved position.

Because of the sleeve 36, the spaces 35 between the stripper fingers 31 are enclosed and thus the press operator is shielded against being hit by parts of the punch 14 which might otherwise fly through the spaces should the punch happen to break. Also, the sleeve prevents the operator's fingers from being inserted into the spaces 35 and placed beneath the punch. Being transparent, the sleeve permits the operator to see the punch and the underlying area of the workpiece 17 so that the workpiece may be positioned under the punch to enable punching of a hole in a proper location as indicated by a prick punch mark or the like on the upper side of the workpiece. The sleeve moves upwardly and downwardly in unison with the stripper 30 when the latter is adjusted but, when the press 10 is idle and no workpiece is present, the sleeve may be slid downwardly along the stripper and into surrounding relation with the die 15 as shown in FIG. 4 to shield against the insertion of a hand between the punch and the die. The sleeve may be cut to length from standard tubular stock of the appropriate diameter and then slit along one side. Accordingly, the guard sleeve 36 may be produced in a simple and inexpensive manner.

Figure 5:
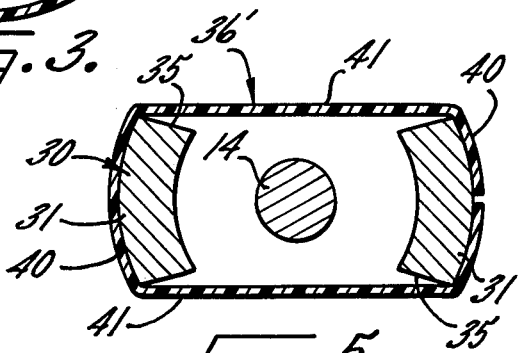
FIG. 5 is a view similar to FIG. 3 but shows a modified guard.

A modified guard sleeve 36' is shown in FIG. 5 and is particularly adapted for use when punching a workpiece such as an angle iron having an upstanding flange or the like. Instead of being of circular cross-section, the sleeve 36' includes two arcuate portions 40 which surround the stripper fingers 31 and further includes two substantially straight portions 41 which extend between the arcuate portions and enclose the spaces 35 between the fingers. By virtue of the straight portions 41, an upstanding portion of a workpiece may be placed immediately adjacent the straight portions and may be located nearer to the punch 14 than is the case when the cylindrical guard sleeve 36 is used. Thus, the sleeve 36' presents less of an obstruction to the workpiece.

We claim:

1. A punch press comrising a frame, a punch supported on said frame to move through advance and return strokes, a die supported on said frame in spaced alinement with said punch and coacting with the punch to form a hole through an intervening workpiece when the punch is moved through said advance stroke, and a stripper secured to said frame and extending alongside said punch to engage the workpiece and strip the latter from the punch when the punch is moved through said return stroke, said stripper being defined by a first finger extending along one side of said punch and by a second finger spaced angularly from said first finger and extending along the opposite side of said punch, the improvement in said press comprising a guard for enclosing the spaces between said fingers to prevent a broken punch from flying through said spaces and for preventing insertion of the press operator's fingers into said spaces, said guard comprising a sleeve of substantially transparent and impact-resistant material, said sleeve being telescoped slidably onto said fingers and surrounding said punch.

2. A punch press as defined in claim 1 in which said material is resiliently yieldable plastic, said sleeve being split axially along one side thereof whereby those portions of the sleeve adjacent the split may be flexed apart to enable removal of said sleeve from said stripper fingers.

3. A punch press as defined in claim 2 in which said sleeve and said stripper fingers are of such relative size that said sleeve is held on said stripper fingers by virtue of the resiliency of said plastic.

4. A punch press as defined in claim 1 in which said stripper fingers are adjustable axially relative to said punch, said sleeve being adjustable in unison with said stripper fingers and also being slidable along said fingers whereby said sleeve may be slid into surrounding relation with said die when the workpiece is not present between the punch and the die.

5. A punch press as defined in claim 1 in which the outer side of each of said stripper fingers is substantially arcuate, said sleeve having substantially arcuate portions surrounding said fingers, and said sleeve further including substantially straight portions extending between said arcuate portions and enclosing said spaces.

* * * * *